US007828261B2

(12) United States Patent
Greer

(10) Patent No.: US 7,828,261 B2
(45) Date of Patent: Nov. 9, 2010

(54) POST MOUNTING ASSEMBLY AND METHOD FOR MOLTEN METAL PUMP

(76) Inventor: Karl E. Greer, 1467 Poplar Grove Rd., Lewisport, Hancock County, KY (US) 42351

( * ) Notice: Subject to any disclaimer, the term of this patent is extended or adjusted under 35 U.S.C. 154(b) by 0 days.

(21) Appl. No.: 12/454,254

(22) Filed: May 14, 2009

(65) Prior Publication Data

US 2009/0283656 A1 Nov. 19, 2009

Related U.S. Application Data

(60) Provisional application No. 61/127,492, filed on May 14, 2008.

(51) Int. Cl.
*F16M 13/00* (2006.01)

(52) U.S. Cl. ..... 248/511; 248/512; 248/678

(58) Field of Classification Search ..... 248/511, 248/512, 513, 521, 523, 539, 637, 644, 678, 248/679, 677; 415/182.1, 213.1
See application file for complete search history.

(56) References Cited

U.S. PATENT DOCUMENTS

| | | | | |
|---|---|---|---|---|
| 5,951,243 | A * | 9/1999 | Cooper | 415/110 |
| 6,336,620 | B1 * | 1/2002 | Belli | 248/519 |
| 2007/0253807 | A1 * | 11/2007 | Cooper | 415/90 |
| 2008/0213111 | A1 * | 9/2008 | Cooper | 417/435 |
| 2009/0140013 | A1 * | 6/2009 | Cooper | 222/594 |
| 2010/0084440 | A1 * | 4/2010 | Mordue | 222/591 |

* cited by examiner

*Primary Examiner*—Ramon O Ramirez
(74) *Attorney, Agent, or Firm*—Gary K. Price

(57) ABSTRACT

A molten metal pump apparatus that includes a base member, at least two (2) support members or posts, and post sockets. The lower end of the posts are mounted to the base and forms a cement-less pump joint which is an objective of the present invention. The upper end of the post is connected to the post socket to form a cement-less pump joint which is a further object of the present invention. The connection joint between the posts and the base member and the post socket does not require cement to form or secure the joint. Therefore a replacement post identical to posts of the present invention may be provided without the need to dig out a cement joint but instead can be more easily removed and replaced.

10 Claims, 6 Drawing Sheets

POST MOUNTING ASSEMBLY AND METHOD FOR MOLTEN METAL PUMP

CROSS REFERENCES TO RELATED APPLICATIONS

U.S. Provisional Application for Patent No. 61/127,492, filed May 14, 2008, with title "Post Mounting Assembly and Method for Molten Metal Pump" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The invention relates to pumping molten metal and more particularly to molten metal pump apparatus and methods for assembling and disassembling such apparatus.

2. Brief Description of Prior Art

A molten metal pump apparatus generally includes a motor mounted above a molten metal bath. The motor drives a rotatable impeller pump having one or more impellers submerged in the bath. In operation, the rotating impellers draw molten material from the bath and pump it through a conduit routed to a subsequent station for further processing.

The molten metal pump typically includes a base having inlet and outlet passages for intake and discharge of the molten metal being pumped. The pump base together with the impeller are submerged in the molten metal, supported on the bottom of the vessel containing the molten metal. The pump base is typically connected by refractory cement and/or mechanical arrangements to a plurality of vertically extending support posts which are also connected to a drive arrangement positioned above the level molten metal. In typical installations, these vertically extending posts may be several feet long, e.g. one to four feet in length or longer, in order to provide adequate clearance between the molten metal level.

The portions of the pump assembly submerged in the molten metal are directly contacted and exposed to the harsh conditions thereof, and are formed of refractory material such as graphite, silicone carbide, alumina, zirconia or hexalloy. The posts extend through a level of the molten metal and are connected to a motor mounting plate of the drive arrangement positioned above the level molten metal.

In prior art arrangements, downwardly opening post sockets are fixed to the motor mounting plate and receive the upper ends of the posts. One or more post sockets may be fixed to a post support plate, as by welding, and the support plate is secured to the motor mounting plate. In prior art arrangements, the posts may also be secured within the post's sockets by means of a refractory cement, bolts or other clamping devices.

Despite the positive properties for this described application, graphite and ceramics still corrode and deteriorate over time, and molten metal pumps must be more frequently maintained and replaced than other types of pumps. The replacement or servicing of a pump having operating components submersed in molten metal is a time consuming exercise. First, the pump must be removed from the molten metal which generally causes down time. Then the pump along with the molten metal contained thereon must be allowed to sufficiently cool to allow it to be disassembled. Once the deteriorated components are sufficiently cooled, the molten metal buildup on the various pump surfaces must be sufficiently removed to allow disassembly and/or re-use of the pump components. Then the pump must be reassembled with the combination of old components or parts, along with the replacement parts.

As previously described, there are certain components of the pump which are typically cemented together in order to achieve a balanced and sufficiently rigid pump structure to allow continuous operation of the pump. However, when the pump must be disassembled, the cemented joints can be very difficult to disassemble.

In the case of the vertical posts between the pump base and the motor mount structure, the posts have traditionally been cemented into bored holes within the base. In the case of the base for example, when the pump is disassembled, the cemented portion of the posts must normally then be chipped, dug or drilled out in order to allow a new post to be placed in the same bore. This makes the disassembly much more difficult. A most significant disadvantage to prior art arrangements is therefore the need to cleanly remove the post when it is necessary to replace the post.

Further, during assembly of the pump, it is important that the pump components be accurately aligned in order for the pump system to work efficiently once it is back in the molten metal. The combination of the components are very heavy, and once the posts for example are cemented in place as described above, it is then very difficult if not impossible to align if necessary.

It is an object of the present invention to provide a pump which does not require as many or any cemented joints as the prior art pumps. It is also an object of the present invention to provide a pump and assembly system which tends to self-align the pump during the assembly process due to its design and configuration, possibly reducing or eliminating the need for alignment apparatuses.

As will be seen from the subsequent description, the preferred embodiments of the present invention overcome shortcomings of the prior art.

SUMMARY OF THE INVENTION

A post mounting assembly for assembling and disassembling a molten metal pump. The post mounting assembly includes a pump base, at least two (2) support members or posts, and post sockets. The assembly of the posts to the mounting base illustrates an embodiment of a cement-less pump joint which is an objective of the present invention. Further, the assembly of the post to the post socket illustrates an embodiment of a cement-less pump joint which is a further object of the present invention. As a result, a replacement post identical to posts of the present invention may be provided without the need to dig out a cement joint but instead can be more easily removed and replaced.

The base of the present invention includes at least two (2) mounting bores therethrough for receiving the lower end of the post. Each mounting bore includes at least one tab disposed substantially adjacent the upper surface of the base member. The at least one tab includes flat surfaces that align with flat surfaces disposed on the lower end of the posts such that the lower end of the posts can be inserted in the mounting bores and rotating the posts within the mounting bores effectively secures the posts to the base member.

The upper end of the posts are shaped and sized to be received within the post socket. The post socket and the upper end of the posts include apertures for alignment and for receipt of a pin member that secures the upper end of the post to the post socket. The coupling configuration between the upper end of the post and the post socket provides very tight tolerances such that the joint connection as described does not require equipment to align the pump during assembly and installation.

DESCRIPTION OF THE PREFERRED EMBODIMENT

Figure 1:
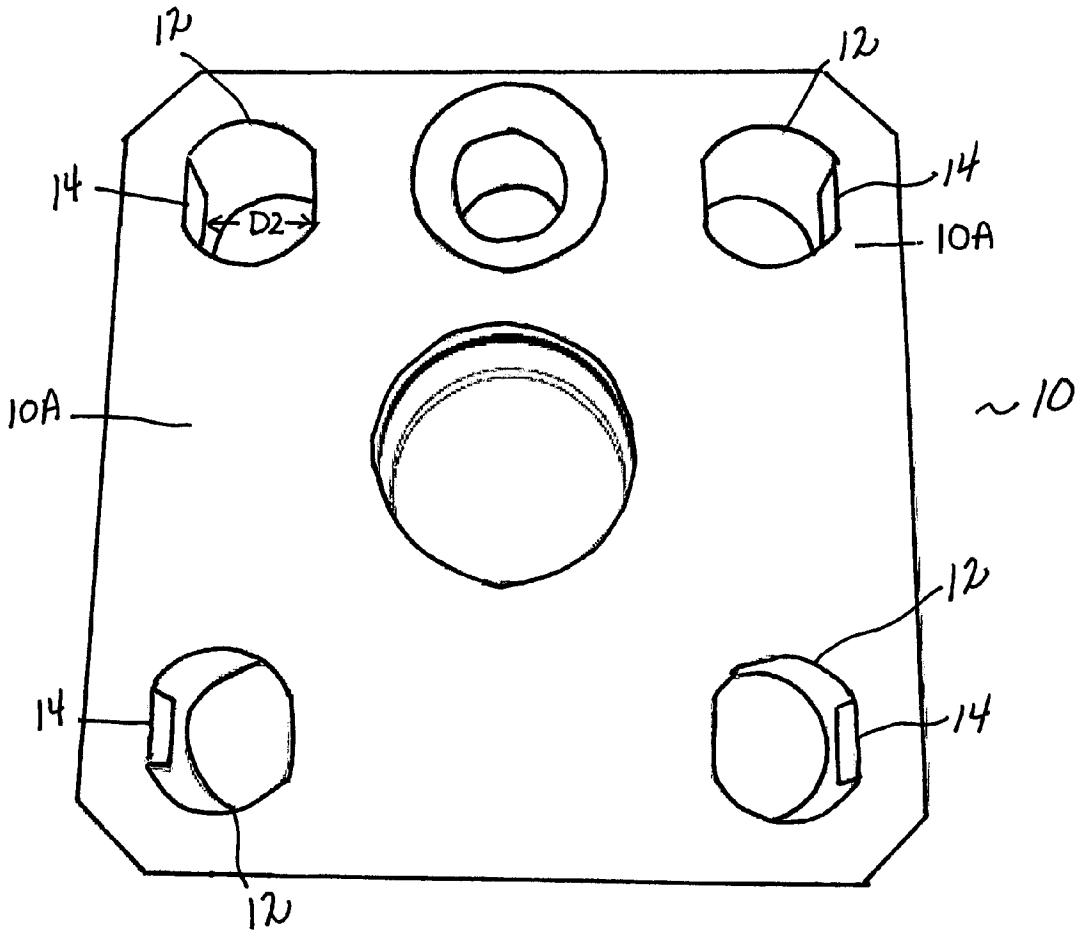
FIG. 1 is a top perspective view of a pump base for a molten metal pump.

In accordance with the present invention, a post mounting assembly and method for molten metal pump is disclosed. The post mounting assembly is directed to a molten metal pump apparatus and method for assembling and disassembling such apparatus. Specifically, it will be noted in the drawings that the post mounting assembly provides a pump assembly which does not require as many or any cemented joints as does prior art pumps. Further, the present invention provides a pump and assembly system which tends to self-align the pump during the assembly process thereby reducing or eliminating the need for alignment apparatuses. In the broadest context, the post mounting assembly for molten metal pump consists of components configured and correlated with respect to each other so as to attain the desired objective.

Figure 5:
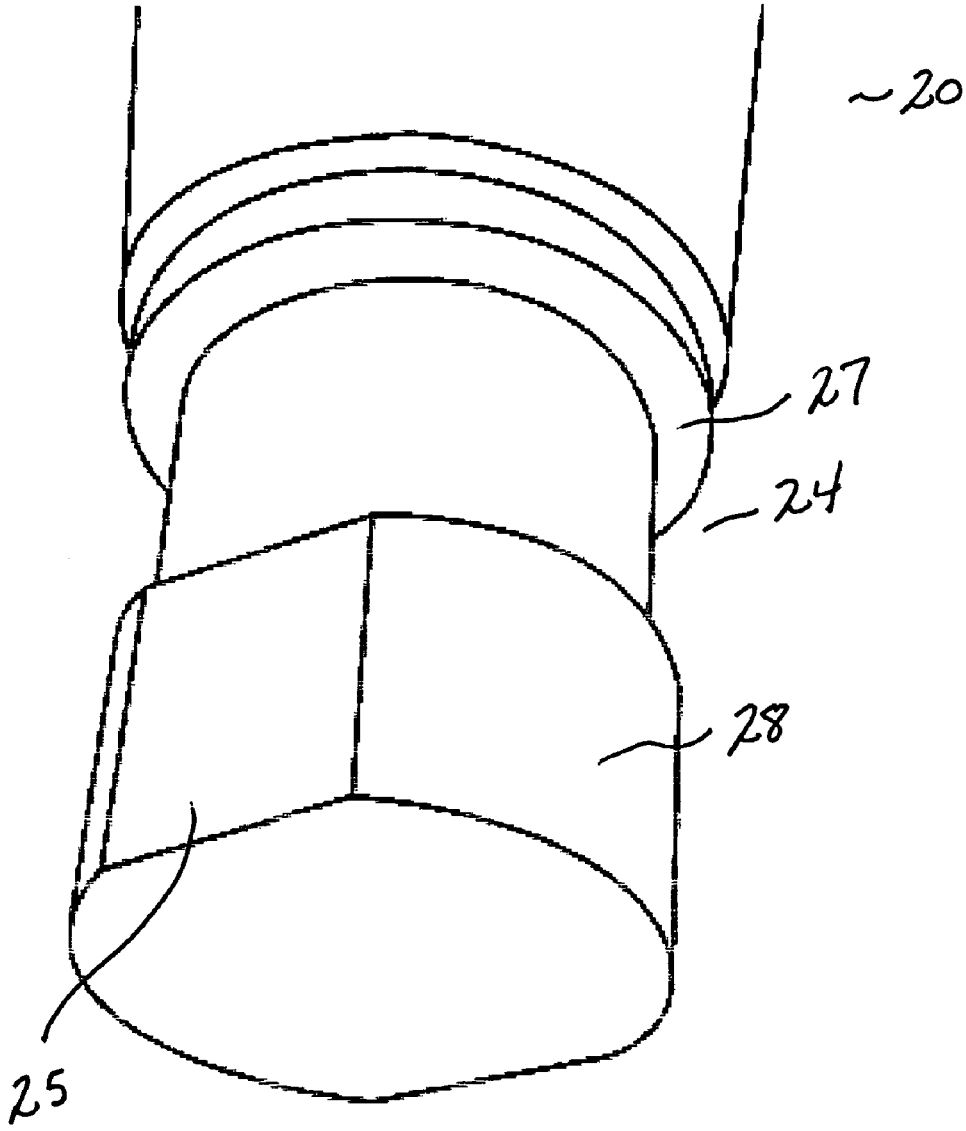
FIG. 5 illustrates a lower end of the post of FIG. 3.
Figure 6:
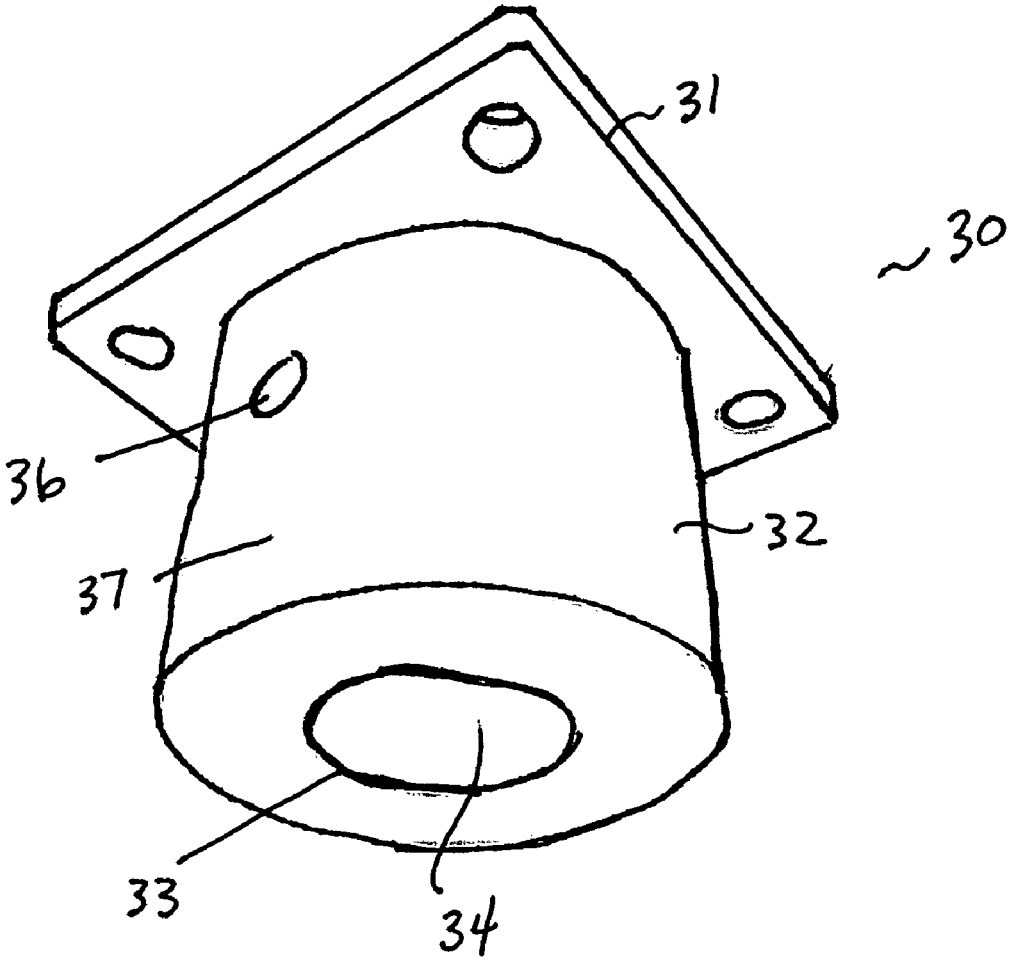
FIG. 6 is a perspective view of a post socket.

FIGS. 1-6 illustrate a preferred embodiment of a post mounting assembly made in accordance with the present invention. The assembly of the present invention includes a pump base 10 (shown in FIGS. 1 and 2), at least two (2) support members or posts 20 (shown in FIGS. 3-5), and a post socket 30 shown in (FIG. 6).

A molten metal pump (not shown) generally includes a base having an impeller mounted therein. The impeller is secured to a driveshaft mounted for rotation within the base. The upper end of the driveshaft is connected to a motor.

The pump further includes at least two (2) identical vertical support members that are spaced apart to provide stability. Each of the vertical support members include an end for connection to a motor mounting plate. Each of the support members further include an end for connection to the base.

The at least two (2) support members or posts 20 of the present invention include an upper end 22 for connection to the motor mounting plate, and a lower end 24 for connection to the base member 10. Each upper end 22 of the posts 20 are connected to the motor mounting plate using the post socket 30. The post sockets 30 are identical. The post socket 30 is described below in greater detail.

Figure 2:
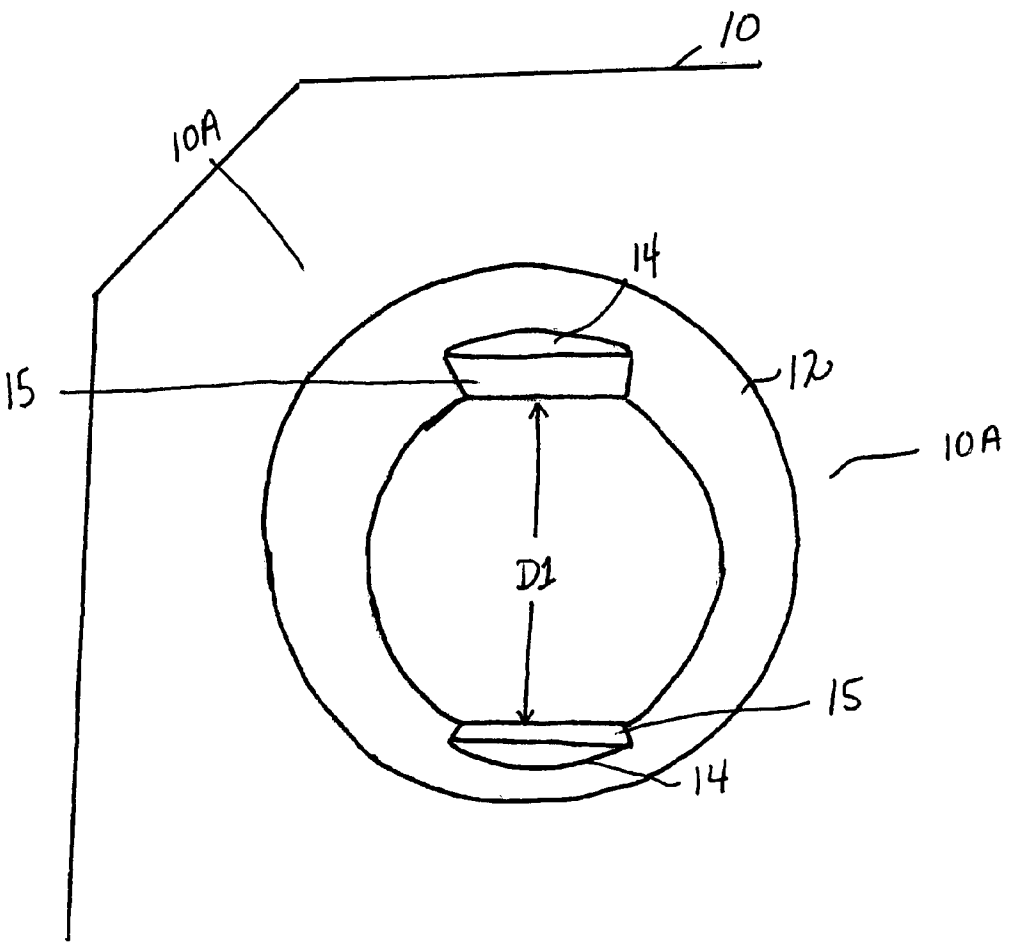
FIG. 2 illustrates one of the bored holes within the base for mounting a vertical post.
Figure 3:
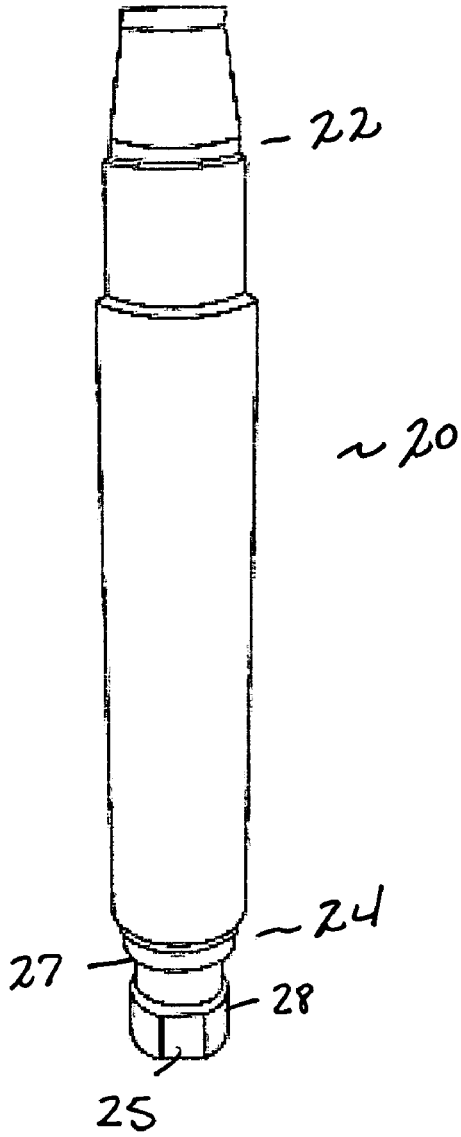
FIG. 3 is a perspective view of a vertically extending post.
Figure 4:
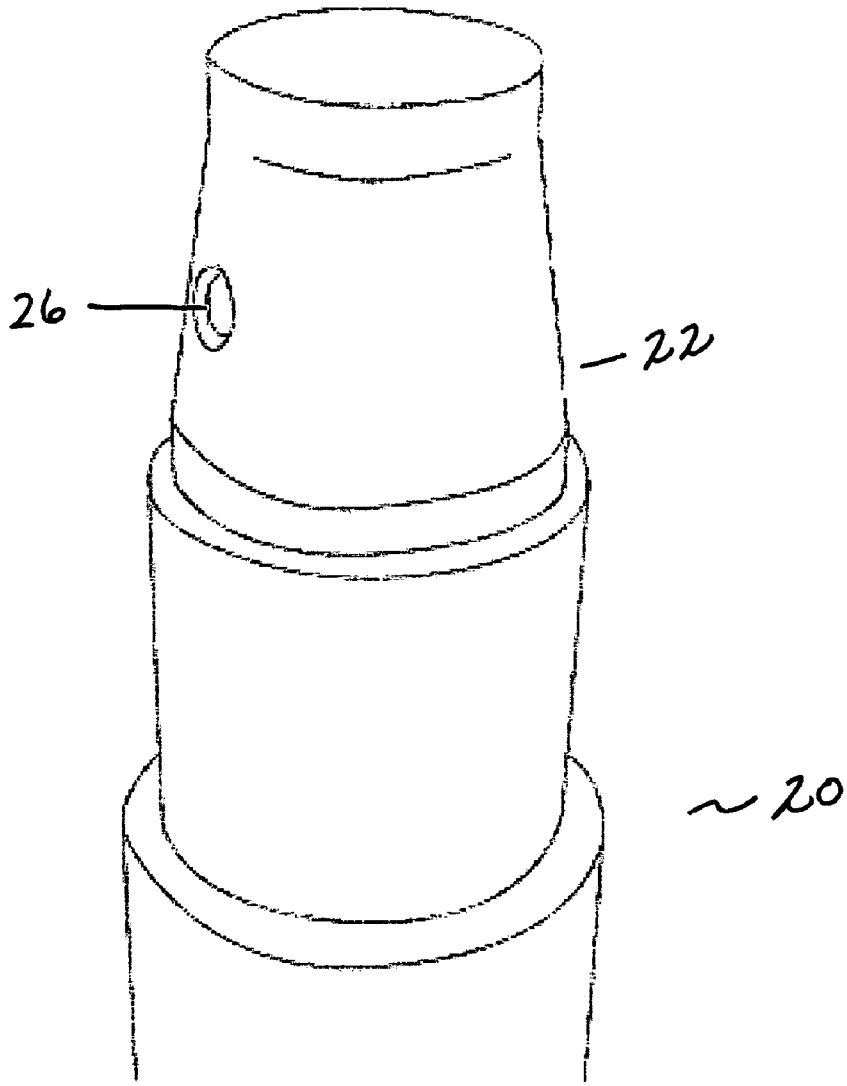
FIG. 4 illustrates an upper end of the post of FIG. 3.

Referring to FIGS. 1-2, the base member 10 includes at least two (2) mounting bores 12 therethrough for receiving the lower end 24 of the post 20. As stated, the mounting bores 12 define a void completely through the base member 10. As shown, the mounting bores 12 have a substantially circular configuration except that each mounting bore 12 includes at least one tab member 14 disposed substantially adjacent the upper surface 10A of the base member 10. Each tab member 14 defines a flat surface 15 within the mounting bore 12 (best shown in FIG. 2).

As shown in FIG. 2, each of the mounting bores 12 include a first distance designated as "D1" which is the diameter of the bore 12 with the at least one tab member 14, and a second distance designated as "D2" (shown in FIG. 1) which is the diameter of the bore 12 below the at least one tab member 14. The first distance D1 is less than the second distance D2 of the mounting bore 12.

FIG. 5 best shows the lower end 24 of the posts 20. The lower end 24 sized and shaped to be received within the mounting bore 12 of the base 10. More particularly, the lower end 24, like the mounting bore 12 includes at least one flat surface 25. In application, aligning the at least one flat surface 25 of the post's lower end 24 with the flat surface 15 of the mounting bore 12 enables the lower end 24 of the posts 20 to be inserted in the mounting bore 12 until the upper surface 10A is in contact with a stop 27 of the lower end 24, which stop 27 serves as a stop for inserting the posts 20. Further, once the stop 27 is in contact with the upper surface 10A as described, a lip 28 of the post's lower end will be disposed within the mounting bore 12 and below the at least one tab member 14. In this position, the post 20 can rotate within the bore 12. Once the lower end 24 is inserted in the mounting bore 12 as described, rotating the post 20 within the mounting bore 12 effectively secures the posts 20 to the base member 10.

As should be understood, further rotating the posts 20 within the mounting bore 12 until the surfaces 15 and 25 are aligned releases the posts 20 from the mounting bore 12.

The assembly of the lower end 24 of the posts 20 to the mounting base 10 as described illustrates an embodiment of a cement-less pump joint which is an objective of the present invention. Therefore a replacement post identical to posts 20 may be provided without the need to dig out a cement joint but instead can be more easily removed and replaced.

Referring to FIG. 6, an upper plate 31 of the post socket 30 is secured to the pump's motor mounting plate (not shown) in any convenient manner, such as, threaded fasteners. The post socket 30 includes a body portion 32 having a surface 35 with an opening 33 to access an interior 34. The opening 33 and interior 34 are sized for receipt of the upper end 22 of the post 20. As will be further described, the upper end 22 of the post 20 is secured within the interior 34 of the body portion 32 with a pin member (not shown) known in the art that in application, is inserted through a post aperture 26 (shown in FIG. 4) that extends through the upper end 22 of the post and a socket aperture 36 that extends through the body portion 32 of the socket 30. More particularly, the pin member secures the upper end 22 of the post 20 to the post socket 30. The pin member is inserted through the aligned apertures 26, 36 when the upper end 22 of the post is positioned within the interior 34 of the body portion 32 of the post socket 30. A retainer (not shown) known in the art secures the pin member within the apertures 26, 36.

After the upper end 22 of the post 20 is inserted into the interior 34 of the body portion 32 and properly rotated to align the apertures 26, 36 as described, the pin member is inserted through the apertures 26, 36 and retained. The pin member is dimensioned such that it fits snugly but slidingly in the passageway defined by the apertures 26, 36 having the substantially same diameter, and is of a length such that it extends through the body portion 32 outer surface 37.

Accurate positioning of the vertical posts 20 is permitted prior to inserting the pin member as previously described.

Thus, the pin member when filled through the apertures 26, 36, will set the posts 20 at a precise position. The result is a precise positioning of the posts and results in precise axial position of the pump's components.

The assembly of the upper end 22 of the posts 20 to the post socket 30 as described illustrates an embodiment of a cementless pump joint which is an objective of the present invention. Therefore a replacement post identical to posts 20 may be provided without the need to dig out a cement joint but instead can be more easily removed and replaced.

This coupling configuration between the upper end 22 of the posts 20 and the post socket 30 provides very tight tolerances such that the joint connection as described does not require other jigs or equipment in order to align the pump during assembly and installation.

It should be appreciated that according to the post mounting assembly and method as described, the posts 20 can be mounted to the base member 10 and the post socket 30 without requiring cement. As a result, disassembling the pump becomes much less difficult. Further, the present invention provides a pump and assembly system which tends to self-align the pump during the assembly process.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. A post mounting assembly for a molten metal pump, said post mounting assembly comprising:

a pump base to be submerged in molten metal, a plate member supported above the level of the molten metal by at least two (2) vertical support posts, each of said posts having a longitudinal length extending from said base to a post socket secured to said plate member, wherein said base includes at least two (2) mounting bores for receipt of a lower end of said posts, each of said bores having a substantially circular configuration and including at least one tab member disposed substantially adjacent an upper surface of said base, wherein said tab member defines a flat surface that partially extends the longitudinal length of said bore and aligns with a flat surface disposed on a lower end of each of said posts, such that aligning said tab member with said surface of said post enables the lower end of the post to be inserted in the bore until an upper surface of said base is in contact with a stop on said lower end of said post, wherein rotating the post within the bore releasably secures the post to the base member, an upper end of said post is sized to be received within said post socket, wherein said post socket and said upper end include apertures that align such that inserting a pin member through said apertures secures the upper end of the post within said post socket.

2. The assembly as recited in claim 1, wherein said post's lower end further includes a lip such that when said stop is in contact with said upper surface, said lip is positioned below the tab member within the mounting bore.

3. The assembly as recited in claim 1, wherein said post socket includes a body portion having an opening to access an interior, said opening and interior sized to receive said upper end of said post.

4. The assembly as recited in claim 1, wherein said mounting bores define a void completely through said base.

5. The assembly as recited in claim 4, wherein each of said mounting bores define a first distance which is the diameter of the bore including the tab member, and a second distance which is the diameter of the bore below the tab member.

6. The assembly as recited in claim 5, wherein said first distance is less than said second distance.

7. The assembly as recited in claim 1, wherein rotating the post within the bore until the flat surfaces of the post and tab member are aligned releases the post from the mounting bore.

8. A post mounting assembly for a molten metal pump, said post mounting assembly comprising:

a pump base to be submerged in molten metal, a plate member supported above the level of the molten metal by at least two (2) vertical support posts, each of said posts having a longitudinal length extending from said base and attached to said plate member, wherein said base includes mounting bores for receipt of a lower end of said posts, each of said bores include at least one tab member that defines a flat surface that partially extends the longitudinal length of said bore and aligns with a flat surface disposed on a lower end of each of said posts, such that aligning said tab member with said surface of said post enables the lower end of the post to be inserted in the bore until said upper surface is in contact with a stop of the post, wherein rotating the post within the bore releasably secures the post to the base member, wherein each of said mounting bores define a first distance which is the diameter of the bore including the tab member, and a second distance which is the diameter of the bore below the tab member, wherein said post's lower end further includes a lip such that when said stop is in contact with said upper surface, said lip is positioned below the tab member within the mounting bore.

9. A post mounting assembly for a molten metal pump, said post mounting assembly comprising:

a pump base to be submerged in molten metal, a plate member supported above the level of the molten metal by at least two (2) vertical support posts, each of said posts having a longitudinal length extending from said base and attached to said plate member, wherein said base includes a plurality of generally circular mounting bores sized to receive a lower end of said posts, each of said bores include a flat surface portion that partially extends the longitudinal length of said bore and aligns with a flat surface disposed on a lower end of each of said posts, such that aligning said flat surface of said bore with said flat surface of said post enables the lower end of the post to be inserted in the bore until an upper surface of said base is in contact with a stop disposed on said post, wherein rotating the post within the bore releasably secures the post to the base member, wherein said plate member includes at least two (2) post sockets, each post socket sized to receive an upper end of said post, and wherein each of said post sockets and said post include apertures that align such that inserting a pin member through said apertures secures the upper end of the post within said post socket.

10. A post mounting assembly for a molten metal pump, said post mounting assembly comprising:

a pump base to be submerged in molten metal, a plate member supported above the level of the molten metal by at least two (2) vertical support posts, each of said posts having a longitudinal length extending from said base and attached to said plate member, wherein said base includes a plurality of generally circular mounting bores sized to receive a lower end of said posts, each of said bores include a flat surface portion that partially extends the longitudinal length of said bore and aligns with a flat surface disposed on a lower end of each of said posts, such that aligning said flat surface of said bore with said flat surface of said post enables the lower end of the post to be inserted in the bore until an upper surface of said base is in contact with a stop disposed on said post, wherein rotating the post within the bore releasably secures the post to the base member, wherein each of said mounting bores define a first distance which is the diameter of the bore including the flat surface, and a second distance which is the diameter of the bore immediately below the flat surface, wherein said post's lower end further includes a lip such that when said stop is in contact with said upper surface, said lip is positioned below the flat surface of the mounting bore.

* * * * *